US010702084B2

(12) United States Patent
Knapp

(10) Patent No.: US 10,702,084 B2
(45) Date of Patent: Jul. 7, 2020

(54) KNIFE/FORK COMBINATION EATING UTENSIL

(71) Applicant: Mark Knapp, Fairbanks, AK (US)

(72) Inventor: Mark Steele Knapp, Fairbanks, AK (US)

( * ) Notice: Subject to any disclaimer, the term of this patent is extended or adjusted under 35 U.S.C. 154(b) by 0 days.

(21) Appl. No.: 15/732,890

(22) Filed: Jan. 16, 2018

(65) Prior Publication Data

US 2019/0216244 A1 Jul. 18, 2019

(51) Int. Cl.

| | |
|---|---|
| ***A47G 21/08*** | (2006.01) |
| ***A47G 21/02*** | (2006.01) |
| ***B26B 11/00*** | (2006.01) |
| ***A47G 21/06*** | (2006.01) |

(52) U.S. Cl.

CPC ..... *A47G 21/08* (2013.01); *A47G 21/02* (2013.01); *A47G 21/06* (2013.01); *B26B 11/006* (2013.01)

(58) Field of Classification Search

CPC ..... A47G 21/06; A47G 21/08; A47G 21/02; A47G 21/023; A47G 21/026; B26B 11/006

USPC ..... 30/123, 142, 144, 147, 148, 149, 150; D7/643; 7/112

See application file for complete search history.

(56) References Cited

U.S. PATENT DOCUMENTS

| | | | | | |
|---|---|---|---|---|---|
| 498,627 | A * | 5/1893 | Cox | A47G 21/08 | 30/148 |
| D41,767 | S * | 9/1911 | Cameron | 30/148 | |
| D43,044 | S * | 9/1912 | Hewitt | 30/148 | |
| 1,300,119 | A * | 4/1919 | Chandler | A47G 21/08 | 30/148 |
| 4,117,593 | A * | 10/1978 | Piligrino | B26B 3/03 | 30/314 |
| 5,113,587 | A * | 5/1992 | Loomis | B26B 3/00 | 30/125 |
| 5,581,895 | A * | 12/1996 | Jeffcoat | B26B 1/02 | 30/294 |
| 6,067,717 | A * | 5/2000 | Perlman | A47G 21/02 | 30/142 |
| 9,901,203 | B2 * | 2/2018 | Olival | A47G 21/08 | |
| 2003/0033023 | A1 * | 2/2003 | McCrae | A47G 21/08 | 623/65 |
| 2014/0137413 | A1 * | 5/2014 | Hanif | A47G 21/02 | 30/123 |
| 2016/0113425 | A1 * | 4/2016 | Olival | A47G 21/08 | 30/148 |

* cited by examiner

*Primary Examiner* — Evan H MacFarlane

(57) ABSTRACT

A knife and fork eating utensil intended for use by individuals who have function of only one hand and those who may also have limited dexterity in the one useful hand. The knife and fork eating utensil includes a rounded blade with a handle affixed to it directly above, a fork attachment, a handle and a removable security strap. Employable by a large demographic, this the knife and fork eating utensil allows the user to safely cut and eat food with one hand only.

1 Claim, 3 Drawing Sheets

KNIFE/FORK COMBINATION EATING UTENSIL

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO SEQUENCE LISTING, A TABLE OR COMPUTER PROGRAM LISTING COMPACT DISC APPENDIX

NOT APPLICABLE

BACKGROUND OF THE INVENTION

This invention relates to eating utensils with the capability of serving multiple functions for use by people with one useful hand and/or have limited dexterity in only one or both hands, particularly being an easily manipulated knife with an attached fork. Two utensils combined allowing for ease of use and a more independent and dignified lifestyle by making it unnecessary to have someone help the user cut food for them.

BRIEF SUMMARY OF THE INVENTION

A knife and fork combination eating utensil. Whereas it is usable by anyone, it's primary intention is to aid individuals that have function of only one hand and to aid individuals that have limited dexterity of the one hand. A rounded knife/ulu is positioned directly below a handle grip and a fork is attached toward the front of the knife blade. A fork provided at the front end of the utensil allows the user to eat without having to put down the knife in order to pick up a fork, thereby eliminating the user's struggle of switching utensils constantly.

BRIEF DESCRIPTION OF DRAWINGS

Referring to FIG. 1, the side view of the instant invention is shown. The utensil has an ergonomic handle (101) located above the rounded ulu blade or blades (102) with a rounded, honed cutting edge (104) and a fork (103) is located above the cutting edge and to the front of the handle. The fork (103) is attached to the blade or blades with a hex-shaped socketed receptacle (107), which allows for multiple angles of orientation. A large space (105) is provided between the handle and the knife blade for less nimble fingers. The security strap (106) is provided above the handle.

DETAILED DESCRIPTION OF THE INVENTION

Figure 1:
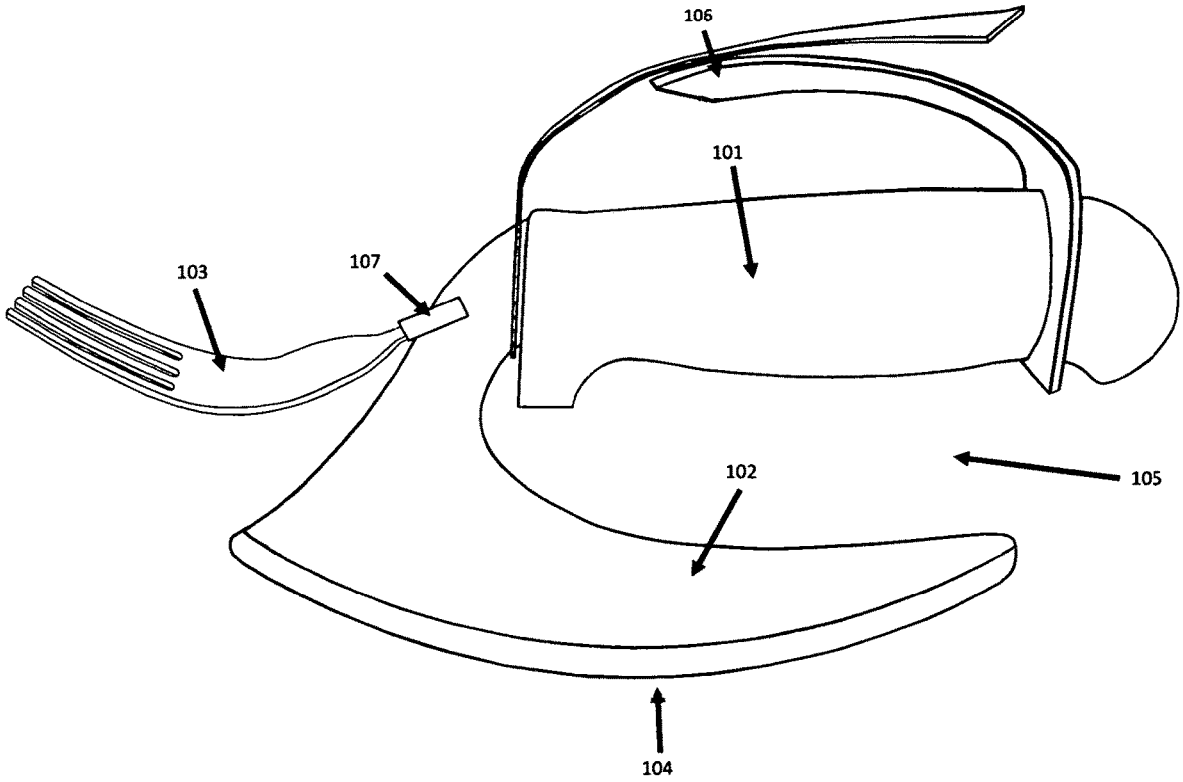
FIG. 1 is the side view of the invention, showing its components.
Figure 2:
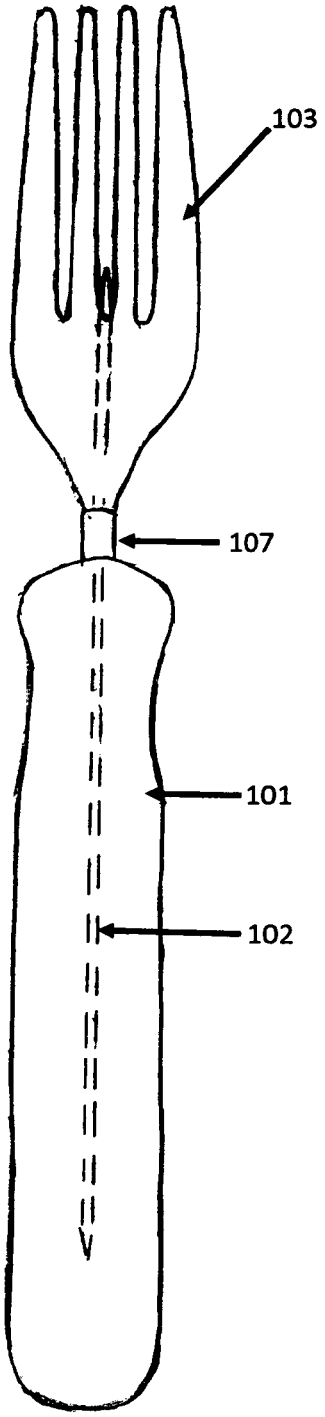
FIG. 2 is the top view.
Figure 3:
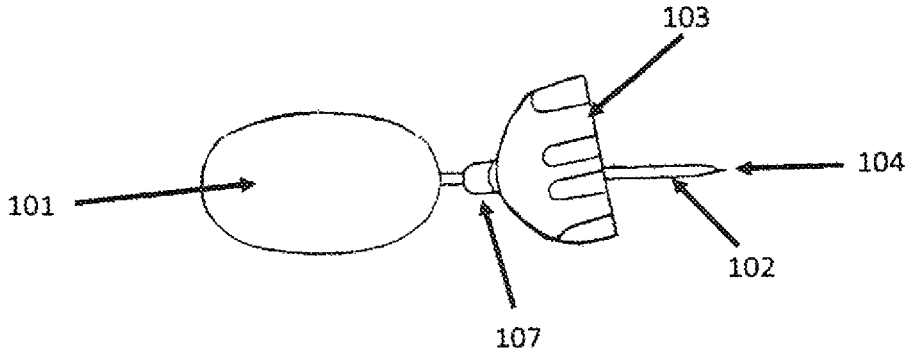
FIG. 3 is the end view.

The knife/fork combination eating utensil resolves these issues and others with its unique design. There are no U.S. patents found available with a similar or comparative design to the knife/fork combination eating utensil. Most of the knife/fork combination utensils that exist involve a more or less sharpened edge on one side of the fork, spoon or other utensil itself. These designs function poorly and unsafely while requiring the user to draw the blade across the food in a slicing motion, often resulting in food sliding across the plate onto the table, lap or floor. Additionally, these designs require that the user fully insert the utensil into their mouth, risking being cut by the blade edge of the apparatus.

The present Invention overcomes all of the difficulties mentioned above. First, the large ergonomic handle (101) is easily grasped by people with limited dexterity and strength in one useful hand. Secondly, the handle is morticed and riveted to the cutting blade (102) directly above, allowing the user to push straight down on the handle while employing a rolling motion. It is much easier for people with limited dexterity and/or strength to push down rather than to draw the utensil across the plate or apply angular pressure. Third, the fork portion (103) of the utensil is T.I.G. welded at a distance sufficiently above the cutting edge to make accidental cutting of the mouth by the user impossible and allowing the manufacturer to sharpen the blade fully, making it a much more effective and efficient eating utensil. Additionally, the front and rear of the blade is rounded and unsharpened, offering another level of safety. The rounded blade is superior to a straight blade because meats and other foodstuffs are more easily cut by applying downward pressure from above while using a rolling motion. A straight blade needs to be drawn through food in a slicing motion for it to be effective. If a second hand is not available to securely hold the food stationary, it is more likely to slide around on the plate, instead of being cut conveniently and safely. These designs function poorly and unsafely while requiring the user to draw the blade across the food in a slicing motion, often resulting in food sliding across the plate onto the table, lap or floor. Additionally, these designs require that the user fully insert the utensil into their mouth and risk being cut by the blade edge of the apparatus.

The present invention overcomes all of the difficulties mentioned above. First, the large ergonomic handle is easily grasped by people with limited dexterity and strength in one useful hand. Secondly, the handle is located directly above the cutting blade, allowing the user to push straight down on the handle while employing a rolling motion. It is much easier for people with limited dexterity and/or strength to push down rather than to draw the utensil across the plate or apply angular pressure. Third, the fork portion of the utensil is attached at a distance sufficient to the cutting edge to make accidental cutting of the mouth by the user impossible and allowing the manufacturer to sharpen the blade fully, making it a much more effective and efficient eating utensil. Additionally, the front and rear of the blade is rounded and unsharpened, offering yet another level of safety.

I claim:

1. A combined knife and fork eating utensil, the utensil comprising:

a handle having a first end and a second end opposite the first end, the handle defining a longitudinal axis extending from the first end to the second end, the handle defining a slot extending into the first end of the handle along the longitudinal axis;

a metal blade having a tang portion, an extension portion, and a cutting portion, the tang portion fixed within the slot defined by the handle, the extension portion adjoining the tang portion and extending from the first end of the handle at an oblique angle relative to the longitudinal axis, and the cutting portion extending from a distal end of the extension portion, wherein the cutting portion includes a curvilinear sharpened cutting edge facing away from the handle, the cutting edge having a first end and a second end, the first end of the cutting edge positioned beyond the first end of the handle in a direction along the longitudinal axis, the second end of the cutting edge positioned between the first end of the handle and the second end of the handle, the cutting portion having a cantilevered section projecting from the extension portion toward the second end of the handle with the cantilevered section being spaced apart from the handle in a direction perpendicular to the longitudinal axis such that the handle and the blade define a gap between the handle and the blade, the gap being open at one side adjacent the second end of the cutting edge to permit fingers of a user to be received in the gap;

a metal fork having a plurality of prongs, the fork attached to the extension portion of the blade at a location between the tang portion and the cutting portion, the fork attached to the blade via a hex-shaped socket, the plurality of prongs extending along the longitudinal axis; and a strap having a first end and a second end, the first end of the strap attached to the blade adjacent the first end of the handle and the second end of the strap attached to the handle adjacent the second end of the handle, the strap for holding a hand of the user inserted between the strap and the handle.

* * * * *